United States Patent [19]

Herr

[11] 4,053,078

[45] Oct. 11, 1977

[54] CHILD SAFETY CLOSURE

[75] Inventor: James E. Herr, East Petersburg, Pa.

[73] Assignee: Kerr Glass Manufacturing Corporation, Los Angeles, Calif.

[21] Appl. No.: 715,238

[22] Filed: Aug. 18, 1976

[51] Int. Cl.[2] ..... B65D 55/02; B65D 85/56

[52] U.S. Cl. ..... 215/222; 215/211; 215/350

[58] Field of Search ..... 215/211, 214, 222, 350

[56] References Cited

U.S. PATENT DOCUMENTS

| | | | |
|---|---|---|---|
| 3,339,770 | 9/1967 | Weigand | 215/214 |
| 3,623,623 | 11/1971 | Bauer | 215/222 X |
| 3,974,928 | 8/1976 | Domaracki et al. | 215/222 X |

*Primary Examiner*—George T. Hall

*Attorney, Agent, or Firm*—Fitch, Even, Tabin & Luedeka

[57] ABSTRACT

A child safe closure of the kind which is secured to a container by interengagement of locking lugs within locking recesses is provided with a sealing member which provides a moisture tight seal with an internal wall of the container. The sealing member has a sealing bead which is inserted deeply within the container opening to a location adjacent or below the lower ends of integrally formed locking lugs or recesses on the container to avoid any depressions made in the interior wall of the container during cooling of thicker cross sectional portions of the container wall. A tapered lead-in surface on the container guides and centers the sealing bead as it travels downwardly toward its sealing position. Preferably, the sealing member is in the form of a separable, flexible sealing fitment retained within the closure cap and formed with an annular flange connected through an annular transverse V-shaped web to a circular planar crown. An annular wall depends from the annular flange and has the peripheral sealing bead thereon. The crown of the fitment is compressed against the top wall of the closure cap to bias the locking lugs into locking relation with the recesses on the container.

18 Claims, 3 Drawing Figures

CHILD SAFETY CLOSURE

The present invention relates generally to safety closures and containers, and more particularly to a safety closure and container which is relatively safe in the hands of children and which includes a novel resilient fitment operative to effect moisture tight sealing relation with the container when the closure is mounted thereon.

Safety closures and containers are known in which the closures have a plurality of locking lugs formed thereon which are cooperative with retaining grooves or recesses formed on the container so as to require a downward and simultaneous rotational movement of the closure to effect locking engagement of the lugs with the retaining recesses. It is also known to provide means within the closure cap to bias the locking lugs into locking relation with the retaining recesses on the container sufficiently to prevent a child of tender years from effecting the proper movement of the closure cap required to remove the closure from the container. See, for example, U.S. Pat. No. 3,896,959, dated July 29, 1975.

Closures of the aforementioned kind provided a good seal with the container or vial but were not intended to or capable of providing a moisture tight seal to limit water vapor from entering the vial. Today, standards now require that moisture vapor be sealed so that less than 100 milligrams per day per liter of volume enter the sealed container and for a 30 to 40cc vial this is about 1 or 2 milligrams of moisture per day.

The market for safety closures and containers which must meet the Federal Food and Drug Administration's standards, such as standards on moisture vapor, is highly competitive so that the cost of manufacture plays a significant role in one's ability to compete. Because of the durability of plastic and its adaptability to high volume production rates, it has become a common practice to employ plastics in making the containers, closures and associated sealing disks, although glass is also employed for the containers. The plastic sealing disks, which may be termed fitments, are formed for insertion within the closure caps and are adapted to cooperate with the associated containers to effect a sealing relation between the closure and container while simultaneously biasing locking lugs on the closure into locking relationship with retaining recesses formed on the container. The fitments are generally relatively thin in cross section and, being flexible, require that the sealing surface on the container be finished to relatively close tolerances. In the case of molded plastic containers, mass production techniques do not always lend themselves to close tolerance finished surfaces, such as the upper rim defining the container opening or the inner peripheral surface of the container neck adjacent the upper rim. As a result, it has been found that the thin flexible fitments which are intended to seal against the upper rim frequently do not form a moisture tight sealing engagement with the container whereby the contents of the container may leak past the closure seal resulting in both waste of the contents and the possibility of harmful consumption by small children. To machine or further process the containers after molding to insure close tolerance finished surfaces at the open mouth rim and internal surface of the open end is, for the most part, economically unfeasible and prohibitive.

In many instances the container is molded from a plastic material which itself has good moisture vapor resistant characteristics, e.g., polypropylene, and the retaining lugs are formed on the exterior of the container adjacent the rim of the container. It has been found that the increased thickness of the plastic material used to form these integral lugs caused the formation of sinks or depressions in the internal wall surface of the container opposite the retaining lugs. The differential thickness of the plastic when cooling apparently causes the formation of these depressions, which, if one attempts to seal thereagainst result in channels or holes through which water vapor and other gases may pass.

Since the particular container described herein is a medicine vial, it is important the moistureproof seal be effective repeatedly with each reclosure of the vial. Moreover, the force required for reclosure should not be excessive or persons of limited strength will be unable to replace the closure.

It is a general object of the present invention to provide an improved child safety closure and container having cooperating locking lugs and recesses and a sealing means to effect a container with the contents maintained in substantially moisture tight sealed relation. A more particular object of the present invention resides in the provision of a child safety closure requiring simultaneous downward and rotational movement of the closure to attach or detach locking lugs on the closure from recesses on the container, and wherein a novel flexible sealing member is provided which serves to provide a moisture tight seal with the container without requiring unduly close tolerance finishing of the upper rim of the container defining the mouth opening over which the closure is applied, as has heretofore been required.

Further objects and advantages of the present invention, together with the organization and manner of operation thereof, will become apparent from the following detailed description of the invention when taken in conjunction with the accompanying drawing wherein like reference numerals designate like elements throughout the several views, and wherein.

Figure 1:
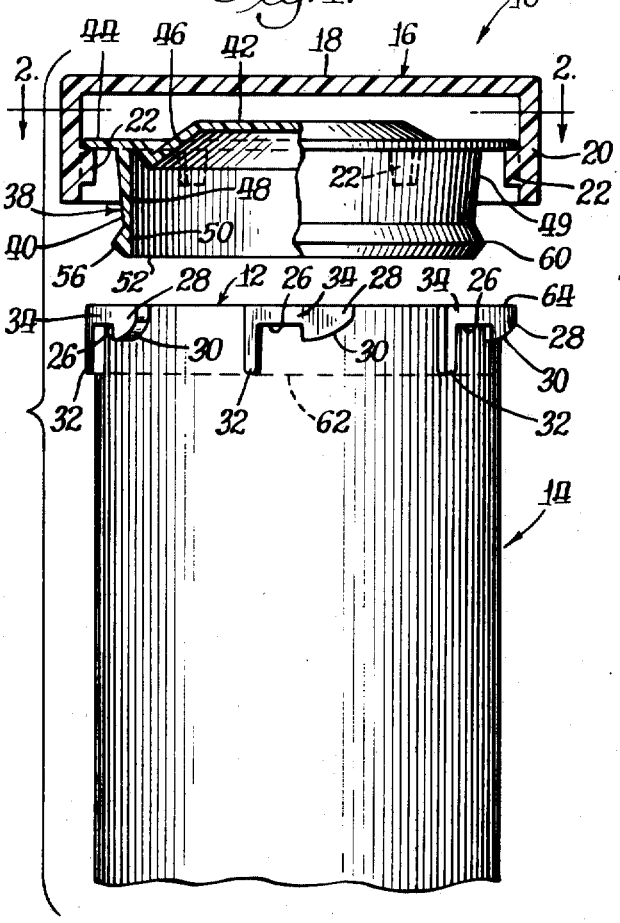
FIG. 1 is a partial elevational view, portions being shown in longitudinal section, illustrating a child safety closure and container in accordance with the present invention with the closure spaced above the container.

Referring now to the drawing, a safety closure, alternatively termed a child safety closure, constructed in accordance with the present invention is indicated generally at 10. The safety closure 10 is adapted to be applied in locking and sealing engagement onto the upper open mouth end, indicated generally at 12, of a container, indicated generally at 14. The container 14 may be made of molded polypropylene or other suitable material which has good moisture barrier properties.

More particularly, the safety closure 10 includes a closure cap, indicated generally at 16, which has an upper planar cap wall portion 18 and a depending annular skirt wall 20. The skirt wall 20 has a plurality of locking members in the form of locking lugs 22, of which there are six in the illustrated embodiment, formed on and projecting radially inwardly from the inner surface of the skirt wall in circumferentially equidistantly spaced relation thereabout. The locking lugs 22 are spaced below the upper cap wall 18 and are cooperable with complementary locking members in the form of locking or retaining recesses or grooves 26 defined by radially outward projections 28 formed on the container 14 adjacent the upper open end 12 thereof so as to releasably mount the closure 10 onto the container. The locking members in the form of the locking lugs 22 and locking recesses 26 define locking lug and locking recess interconnection between the container 14 and the closure 10.

Figure 3:
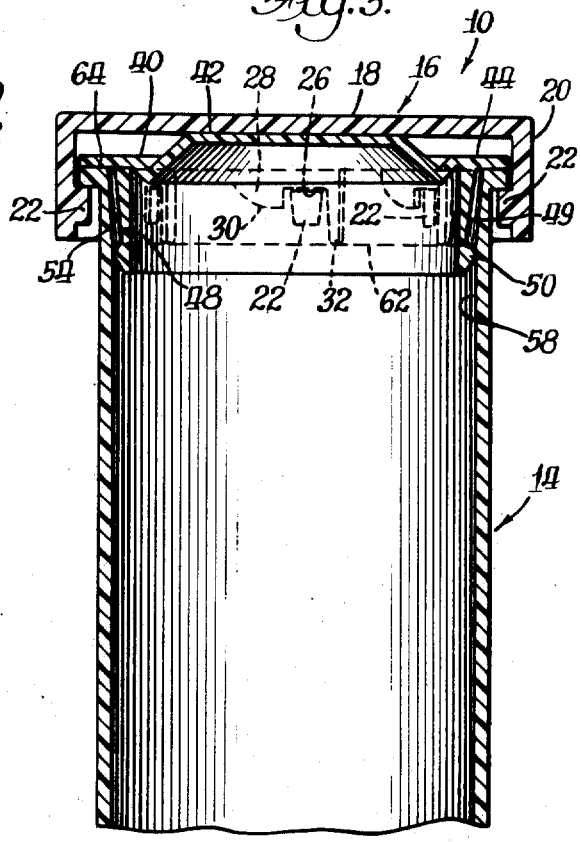
FIG. 3 is a partial longitudinal sectional view illustrating the child safety closure of FIG. 1 mounted on the container.
Figure 2:
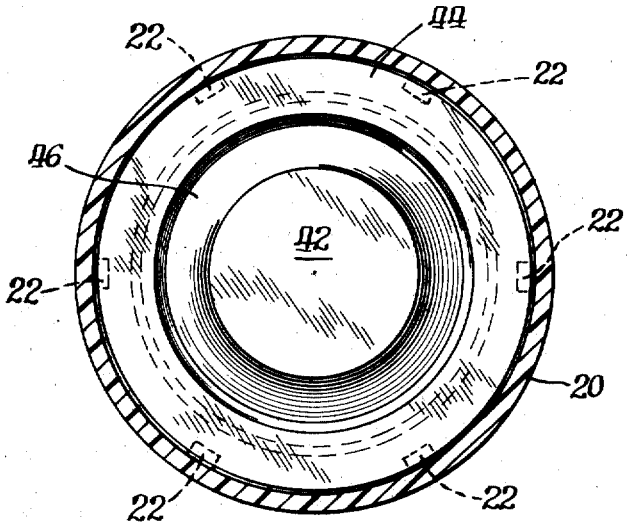
FIG. 2 is a transverse sectional view, taken substantially along the line 2—2 of FIG. 1.

With particular reference to FIGS. 1 and 3, each of the retaining recesses 26 on the container 14 opens downwardly toward the bottom of the container and is defined by a cam wall 30, a longitudinal stop wall 32 and an upper bridge 34 which defines the top of the recess 26. In mounting the closure cap 16 on the container 14, the closure cap is brought to a position wherein the locking lugs 22 can move downwardly onto the container 14 between the recesses 26 whereupon the closure cap is moved downwardly over the container and simultaneously rotated to engage the locking lugs 22 within the downwardly open retaining recesses 26. The dimensional configurations of the locking lugs 22 on the closure cap and the radial projections 28 on the container 14 to facilitate interlocking of the closure cap with the container are described in greater detail in the aforenoted U.S. Pat. No. 3,896,959, which is incorporated herein by reference to the extent necessary to more particularly describe the locking lugs 22 and retaining recesses 26. The upper open end 12 of the container 14 is defined by an annular wall or neck of the container which has the radial projections 28 formed on its outer surface adjacent the upper edge thereof. The radial projections 28, in this instance, define recesses for receiving the locking lugs 22 on the cap; but this may be reversed with the locking lugs formed on the container and with the recesses formed in the skirt wall of the closure cap.

To provide a moisture tight seal between the closure 10 and the container 14 to substantially exclude the intrusion of moisture vapor to levels equal to or less than U.S. Government standards, the closure 10 is formed with a sealing member, indicated generally at 38, having a sealing surface adapted for engagement with the internal wall of the container at a predetermined distance axially downwardly from the upper open mouth end 12 of the container, as will become more apparent below. While it is possible to form the sealing member integral with the remainder of the closure 10, it is preferred to form the sealing member 38 as a separate fitment 40 of a plastic material having greater flexibility than the plastic material used for the skirt wall and top wall of the closure cap 16.

As will be explained in detail, the fitment 40 is retained within the closure cap 16 and is adapted to effect a moisture tight sealing relation with the container 14 when the closure 10 is mounted on the container. The fitment 40 is made of a low-density polyethylene, or other suitable plastic, which has good moisture barrier properties and flexibility, and is formed as a unitary member by conventional molding or other suitable manufacturing techniques. The fitment 40 includes a generally planar circular crown portion 42 which is formed integral with an annular flange 44 through an interconnecting annular transverse V-shaped web 46 such that the plane of the crown 42 is disposed above the plane of the annular flange 44 a predetermined distance, as will become more apparent below.

The fitment 40 includes a downwardly depending annular wall 48 formed integral at its upper end with the lower surface of the annular flange 44 adjacent the V-shaped web 46. The annular wall 48 has a frustoconical outer peripheral surface 49 which terminates at its lower edge in a radially outwardly directed circumferential sealing bead 50 formed adjacent a lower annular edge surface 52 of the wall 48.

The fitment 40 is formed so that the annular flange 44 has an outer diameter greater than the diameter of the innermost surfaces of the radially inwardly projecting locking lugs 22 on the closure so that the fitment may be inserted within the closure cap 16 and retained therein by the locking lugs 22 as shown in FIG. 1. As seen in FIG. 1, the fitment crown 42 is spaced above the plane of the annular flange 44 a distance less than the axial spacing of the lugs 22 below the roof 18 of the closure cap. The crown 42 of the fitment is formed to lie above the plane of the flange 44 by a distance sufficient to effect compression of the crown 42 against the upper cap wall 18 of the closure cap 16 when the closure cap is mounted on the container 14 with the locking lugs 22 disposed within the retaining notches 26. The compressive force exerted by the crown of the fitment against the roof of the closure cap biases the locking lugs 22 upwardly against the bridges 34 defining the upper ends of the retaining notches 26. The preferred configuration of the fitment 40 is such as to require a minimum of 5 lbs. pressure and a maximum of 14 lbs. pressure acting downwardly on the closure cap 16 to move the locking lugs 22 downwardly a sufficient distance to allow rotation of the closure cap in a direction to release the locking lugs from the retaining recesses 26 for removal of the closure 10 from the container 14.

The container 14 is formed with an upwardly and outwardly tapered frustoconical lead-in surface 54, FIG. 3, within the upper open neck end of the container. The lead-in surface 54 is particularly useful in applying the closure 10 to the container in that the sealing bead 50 has a diameter less than the diameter of the top end of the lead-in surface and hence the bead need not be precisely centered to fit therein. Thus, the fitment bead will be centered automatically by the tapered lead-in surface as the bead 50 moves downwardly therealong. An inclined edge 56 on the bead 50 also facilitates the camming and centering of the fitment into a properly centered position to slide down the lead-in surface. In commercial practice, the closures are applied automatically by machines to the containers and are sold with the closure thereon to druggists or the like.

The thickened cross section for the bead 50 assures that the bead is relatively stiff to assume and maintain a circular configuration in contact with the wall and will not be displaced into an oval or other configuration which would allow gases and moisture to enter. Also, the thickened cross section with the tapered surface 56 prevents wear or damage to this lower sealing end of the fitment whereas, in contrast, a very thin sealing end may be damaged by abutting the container rim after reusage and lose its sealing capability.

It has been found that in forming plastic containers 14 such as aforedescribed by molding, the interior tapered lead-in surface 54 or the interior surface 58 of the container immediately below the lead-in surface may not be perfectly round, as considered in section planes through these areas transverse to the longitudinal axis of the container. This is due to that fact that the greater thicknesses of the container wall through the outward lugs or projections 28 defining the locking recesses on the container cause a differential cooling of the container wall adjacent the open end 12. Such differential cooling may cause surface irregularities in the form of sinks or depressions in the internal wall surface of the open mouth of the container, with the result that an out-of-round surface condition is created. The extent of differential cooling and thus the extent of a possible out-of-round internal surface condition at the open mouth of a container 14 depends upon the configuration of the retaining lugs 28 formed on the container. If, for example, the radial thickness of the locking lugs 28 is uniform throughout their axial lengths, as is the case with the illustrated embodiment, an out-of-round internal surface condition may exist axially downwardly to the lower ends of the long stop walls 32 which, in the illustrated embodiment, coincides with the lower edge 62 of the lead-in surface 54. If, for example, the locking lugs or projections 28 on the container are tapered radially inwardly toward their lower ends, the out-of-round condition may exist adjacent the upper open end 12 of the container but will not exist as deeply into the container neck as the lower edge 62 of the lead-in surface 54.

In accordance with a most important aspect of the invention, the sealing bead 50 is adapted to engage the interior surface of the container at a location axially below any out-of-round surface within the neck of the container. In accordance with the illustrated embodiment, the sealing bead 50 is formed to engage the internal surface of the container neck generally adjacent, and preferably axially below, the lower ends of the long stop wall portions 32 of the radial projections 28, and hence below any recesses or indentations in the internal surface of the container wall formed, as described above, by differential cooling of the plastic container wall at the location of the projections 28. It has been found that such depressions act as channels or openings through which moisture vapor may pass in sufficient quantities to prevent attaining of the desired moisture tight standards. Herein, the sealing bead has a pointed circumferentially extending edge 60 which engages the cylindrical interior wall 58 of the container at a location below the lower edge 62 (FIGS. 1 and 3) of the lead-in surface 54 and below the lower ends of the stop walls 32 of the locking projections on the container. As noted, in the embodiment of FIG. 1 the lower ends of the stop walls 32 terminate at substantially the same axial location as the lower edge 62 of the lead-in surface 54. The sealing edge 60 is sized to have a slightly larger diameter than the internal cylindrical diameter of the container's cylindrical wall 58 so that the sealing edge is compressed radially inwardly by the wall 58 at a location below the lead-in surface and below the locking projections 28.

In manufacturing plastic and glass containers having configurations as described in respect to the container 14, that is, having locking recess projections 28 formed circumferentially thereabout adjacent the upper open ends thereof, and particularly when manufacturing such containers on a mass production basis, the upper annular edge surface, as indicated at 64 on the container 14, may not be planar within close dimensional tolerances. As a result, when a closure and associated fitment such as 40 are mounted on the container with the annular flange 44 of the fitment engaging the upper edge 64 of the container, a moisture tight seal between the fitment flange 44 and the upper edge of the container is not accomplished. It is also a common practice in manufacturing containers such as the container 14 by molding to provide one or more vent grooves in the upper annular edge 64 to allow escape of gas during molding. The vent grooves prevent full circumferential sealing contact between the fitment flange and the upper edge of the container neck. While the upper edge of the container neck could be machined to eliminate the grooves, the added machining adds to the manufacturing costs.

From the foregoing it will be seen that the annular sealing bead 50 forms a moisture tight seal with the container internally of the open mouth thereof below any lead-in surface thereon and that compression of the crown 42 of the fitment against the cap wall 18 of the closure cap 16 acting through the V-shaped web 46 biases the locking lugs into locked engagement within the locking recesses to maintain the container contents packaged against excessive moisture intrusion. The need for a true planar upper edge 64 on the container is eliminated. The sealing bead 50 forms a circumferential line contact seal through the circumferential edge 60 with the inner opposed surface 58 of the container so that a relatively high sealing pressure is exerted at the contact area between the sealing bead and the container.

Thus, in accordance with the present invention, a safety closure is provided which is particularly suited for containers intended for storage of products which are of possible danger to children of tender age. The closure in accordance with the present invention requires movement of the closure cap under pressures generally outside the capabilities of children of tender age. Of equal importance is the provision of a closure employing a sealing member adapted to effect a full circumferential moisture tight relationship with the interior surface of a container, particularly molded plastic containers having integrally molded projections thereon which may cause an out-of-roundness or surface irregularity in the inner surface wall of the container adjacent its upper open neck. The closure is easily applied with the sealing bead being centered and guided downwardly by a tapered lead-in surface to an axial location below any out-of-round surface area, and preferably below the locking lugs or projections and the lower end of the tapered lead-in surface. The compression of the fitment serves to bias the locking lugs of the closure into locking relation with the retaining notches 26 on the container.

While a preferred embodiment of the present invention has been illustrated and described, it will be obvious to those skilled in the art that changes and modifications may be made therein without departing from the invention in its broader aspects. Various features of the invention are set forth in the following claims.

What is claimed is:

1. A safety closure for moisture tight sealing engagement with a container having an open mouth over which said closure is received, said closure having a top wall adapted to extend across the open mouth of the container and having a depending skirt wall attached to and encircling said top wall, a plurality of locking members formed on the inner surface of said depending skirt wall for cooperation with locking members on the container to selectively retain said closure on said container, said locking members defining locking lug and locking recess interconnection between the container and closure, biasing means within said encircling skirt wall for engaging said container and for being compressed and flexed to bias the locking members on said closure into locking relationship with the locking members on the container until said closure is forced downwardly and rotated relative to the container to release said closure, said closure having an annular depending wall encircled by said skirt wall for insertion into the open mouth of the container to project downwardly therein a predetermined distance axially below said locking members, and a circumferential radially outward sealing surface located on and adjacent the lower end of said annular depending wall axially below said locking members for sealing engagement with the interior surface of said container generally axially below the lower ends of said locking members on said container.

2. A closure in accordance with claim 1 in which an annular bead is formed on said annular depending wall, an inclined surface is provided on said bead for camming engagement with an interior tapered lead-in surface at the mouth of the container, and in which said sealing surface is formed on said bead, said bead being located for sealing engagement with the interior surface of said container at a location axially below said locking members on said container.

3. A closure in accordance with claim 1 in which a separable fitment is mounted within said closure, said fitment having said biasing means for engaging said container thereon and having said annular depending wall and said sealing surface thereon, said separable fitment being formed of a different and more flexible material than the material used to form said top wall and said depending skirt.

4. A safety closure and container, said container having an upstanding side wall with an open mouth over which said closure is received in moisture tight sealing engagement with said container, said closure having a top wall adapted to extend across the open mouth of said container and having a depending skirt wall attached to and encircling said top wall, said container having a plurality of locking members thereon defining areas of non-uniform cross-sectional thickness in the upper portion of said container, a plurality of locking members formed on the inner surface of said depending skirt wall for cooperation with said locking members on said container to releasably retain said closure on said container, said locking members defining locking lug and locking recess interconnection between said container and closure, biasing means within said encircling skirt wall and engaging said container and being compressed and flexed to bias said locking members on said closure into locking relationship with said locking members on said container until said closure is forced downwardly and rotated relative to said container to release said closure, a tapered lead-in surface on the interior of said container side wall, a cylindrical wall beneath said tapered lead-in wall, said closure having an annular depending wall encircled by said skirt wall and received within said open mouth of the container to project downwardly therein a predetermined distance, and a circumferential radially outward sealing surface located on and adjacent the lower end of said annular depending wall for sliding engagement with said tapered lead-in wall to move downwardly for sealing engagement with the interior to engage said cylindrical wall of said container at a location axially spaced from said non-uniform cross-sectional thickness areas defined by said container locking members and any out-of-roundness due to said increased thickness at said container locking members.

5. A safety closure and container in accordance with claim 4 in which an annular bead is formed on said annular depending wall, an inclined surface is provided on said bead for camming engagement with an interior tapered lead-in surface at the mouth of the container, and in which said sealing surface is formed on said bead.

6. A safety closure and container in accordance with claim 4 in which a separable fitment is mounted within said closure, said fitment including said biasing means for engaging said container and having said annular depending wall and said sealing surface thereon, said separable fitment being formed of a different and more flexible material than the material used to form said top wall and said depending skirt.

7. A safety closure and container, said container being made of polypropylene and having an open mouth over which said closure is received in moisture tight sealing engagement with said container, said container having a tapered lead-in surface internally adjacent said open mouth, said closure having a top wall adapted to extend across the open mouth of said container and having a depending skirt wall attached to and encircling said top wall, said container having a plurality of locking members thereon defining areas of non-uniform cross-sectional thickness in the upper portion of said container, a plurality of locking members formed on the inner surface of said depending skirt wall for mutual cooperation with said locking members on said container to releasably retain said closure on said container, said locking members defining locking lug and locking recess interconnection between said container and closure, said closure including a flexible fitment made of polyethylene and releasably and loosely retained within said encircling skirt wall, said fitment engaging said container and biasing said locking members on said closure into locking relationship with said locking members on said container until said closure is forced downwardly and rotated relative to said container to release said closure, said fitment having an annular depending wall encircled by said skirt wall and received within said open mouth of the container to project downwardly therein a predetermined distance, and a circumferential radially outward sealing surface located on and adjacent the lower end of said annular depending wall for sealing engagement with the interior surface of said container at a location spaced axially of said locking members on said container and spaced axially from said non-uniform cross-sectional areas defined by said container locking members so as to be located below any out-of-roundness in the container surface defining said open mouth thereof, said sealing surface engaging said lead-in surface and guiding said loosely retained fitment to a centered position in said container open mouth.

8. A safety closure for use with a container having an open mouth defined by an annular neck wall having an annular end surface, and a plurality of retaining notches formed on its outer surface adjacent said end surface, said safety closure comprising a closure cap having a roof and an annular depending skirt, said skirt having a plurality of locking lugs internally thereon cooperable with said retaining notches to releasably retain said cap on the closure, a fitment retained within said cap and adapted to effect a moisture tight sealing relation with the container when said cap is mounted thereon, said fitment having a generally planar crown and an annular flange disposed circumferentially of said crown and interconnected thereto so that said crown lies in a plane spaced from the plane of said annular flange, an annular wall secured to said flange and depending from the side thereof opposite said crown, said depending wall being adapted to extend axially within the mouth of the container and having a circumferential radially outward sealing bead adapted for engagement with the interior surface of said annular neck wall when said closure is mounted on said container, said sealing bead being located axially below said locking lugs, said fitment being of a configuration such that said annular flange engages said annular end surface of said container and causes said crown to be compressed against said roof of said closure cap when said cap is mounted on the container, said compression of said crown serving to bias said locking lugs into locking relation within said retaining notches and bias said sealing bead against said inner surface of the annular neck wall in sealing contact therewith.

9. A safety closure as defined in claim 8 wherein said annular flange is connected to said planar crown through an annular web of substantially V-shaped transverse configuration, said depending wall being integrally connected to said annular flange circumferentially of said web and adjacent thereto.

10. A safety closure as defined in claim 8 wherein said planar crown is spaced above said fitment a distance greater than the maximum distance between said roof of said closure cap and the annular end surface of said container neck when said closure is mounted on the container with said locking lugs disposed within said retaining notches.

11. A closure cap as defined in claim 8 wherein said crown lies in a plane parallel to the plane of said annular flange.

12. A safety closure as defined in claim 8 wherein said fitment is resilient.

13. A safety closure as defined in claim 8 wherein said fitment is retained within said closure cap by said locking lugs.

14. A safety closure as defined in claim 13 wherein said locking lugs are equidistantly axially spaced from said roof of said closure cap a first distance, and wherein said crown is spaced from the plane of said annular flange a second distance less than said first distance.

15. A safety closure as defined in claim 8 wherein said sealing bead has a configuration to effect substantially line sealing contact with the interior surface of said annular neck wall when said closure is mounted on the container.

16. A safety closure as defined in claim 8 wherein the container has a frustoconical lead-in surface formed on the interior surface of said annular neck wall adjacent the annular end surface thereon, and wherein said annular wall of said fitment is of sufficient axial length so that said circumferential sealing bead engages the interior surface of said annular neck wall below said lead-in surface.

17. A closure in accordance with claim 7 in which said sealing surface is in the form of a radially outwardly projecting continuous bead having a tapered surface for engaging the tapered lead-in surface of said container and providing a thickened lower end to prevent damage thereto by the container edge.

18. A combination in accordance with claim 17 in which the top wall of the container is formed with depressions therein and in which said fitment has a flange disposed over said top wall, said flange lacking in sealing engagement with said top wall because of said depressions so that the only sealing engagement is between the sealing bead and the internal wall surface of the container.

* * * * *